United States Patent [19]

Cephas et al.

[11] Patent Number: 4,740,932

[45] Date of Patent: Apr. 26, 1988

[54] DESK TOP SWING CALENDAR

[76] Inventors: Ernest Cephas, 4928 Charlemar Dr., Cincinnati, Ohio 45227; George Spector, 233 Broadway RM 3815, New York, N.Y. 10007

[21] Appl. No.: 54,234

[22] Filed: May 26, 1987

[51] Int. Cl.[4] ..... G04B 19/24; G09D 3/04

[52] U.S. Cl. ..... 368/28; 368/29; 40/119; 40/120

[58] Field of Search ..... 368/28–30, 368/10, 278, 223; 40/111, 107, 119, 120; D10/2, 3; D19/20, 21

[56] References Cited

U.S. PATENT DOCUMENTS

| | | | |
|---|---|---|---|
| 2,343,969 | 3/1944 | Forbes | 40/111 |
| 3,090,143 | 5/1963 | Arnold | 40/120 |
| 3,276,198 | 10/1966 | Barbera | 368/28 |

FOREIGN PATENT DOCUMENTS

| | | | |
|---|---|---|---|
| 653568 | 3/1929 | France | 40/119 |

*Primary Examiner*—Vit W. Miska

[57] ABSTRACT

A desk top swing calendar is provided and consists of a support frame with clock and a calendar tablet so as to display the time and the month of the year simultaneously. In a modification a calendar month page turner and means for viewing current month with last month at the same time is also provided.

6 Claims, 1 Drawing Sheet

DESK TOP SWING CALENDAR

BACKGROUND OF THE INVENTION

The instant invention relates generally to calendar clocks and more specifically it relates to a desk top swing calendar.

Numerous calendar clocks have been provided in prior art that are adapted to indicate hours, minutes, days of the week and day of the month. For example, U.S. Pat. Nos. 1,988,782; 3,276,198 and 3,964,196 all are illustrative of such prior art. While these units may be suitable for the particular purpose to which they address, they would not be as suitable for the purposes of the present invention as heretofore described.

SUMMARY OF THE INVENTION

A primary object of the present invention is to provide a desk top swing calendar that will overcome the shortcomings of the prior art devices.

Another object is to provide a desk top swing calendar that includes a clock and a calendar tablet so as to display the time and also the month of the year simultaneously.

An additional object is to provide a desk top swing calendar that includes a calendar month page turner and means for viewing current month and last month at the same time.

A further object is to provide a desk top swing calendar that is simple and easy to use.

A still further object is to provide a desk top swing calendar that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
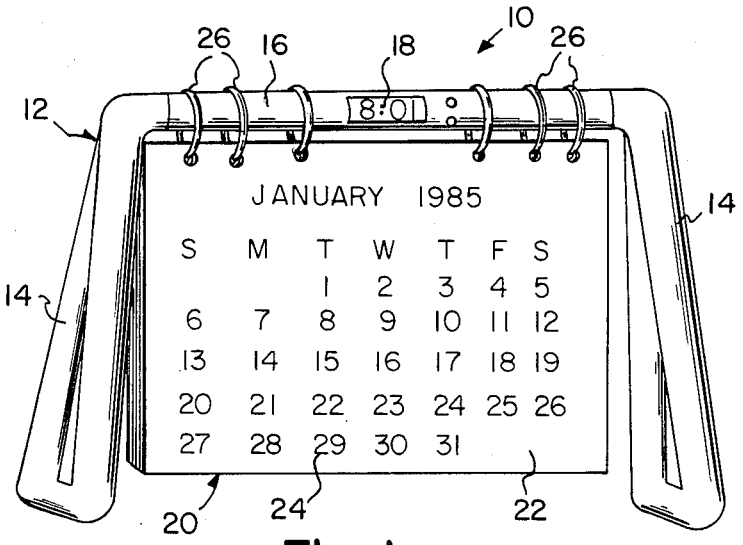
FIG. 1 is a perspective view of the invention.
Figure 2:
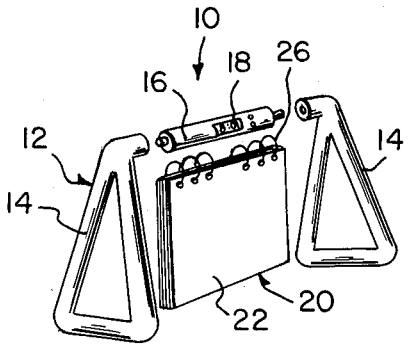
FIG. 2 is an exploded perspective view thereof.

Turning now descriptively to the drawings, in which similar reference characters denote similar elements throughout the several views, FIGS. 1 and 2 illustrate a desk top swing calendar 10 that consists of a support frame 12 that has a pair of side legs 14 and a cross beam member 16. A clock 18 is mounted within the cross beam member 16 to indicate time of day. A calendar tablet 20 that has a plurality of pages 22 with month, year and date indicia 24 thereon is suspended on the cross beam member 16 of the support frame 12 so that the pages 22 can be manually flipped over to expose each month of the year.

The side legs 14 and the cross beam member 16 of the support frame 12 are detachable from each other (see FIG. 2) so as to allow replacement of the calendar tablet 20 when needed. A plurality of rings 26 extend through top of the calendar tablet 20 and around the cross beam member 16 of the support frame 12 to be suspended therefrom. The clock 18 of the desk top swing calendar 10 is of a liquid crystal display type.

Figure 3:
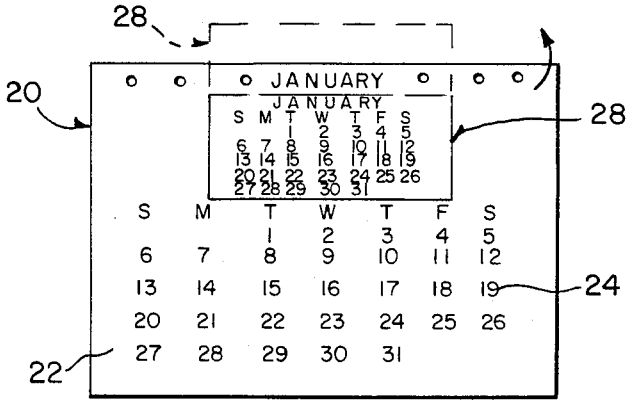
FIG. 3 is a front view of a modified calendar month page having a small calendar month flap therein so that a person can flip up to see next month behind.

As shown in FIG. 3 each of the pages 22 of the calendar tablet 20 further includes therein a small calendar 28 being of the same month and cut out on both sides and bottom which can be manually flipped up to expose following month underneath the page 22.

Figure 4:
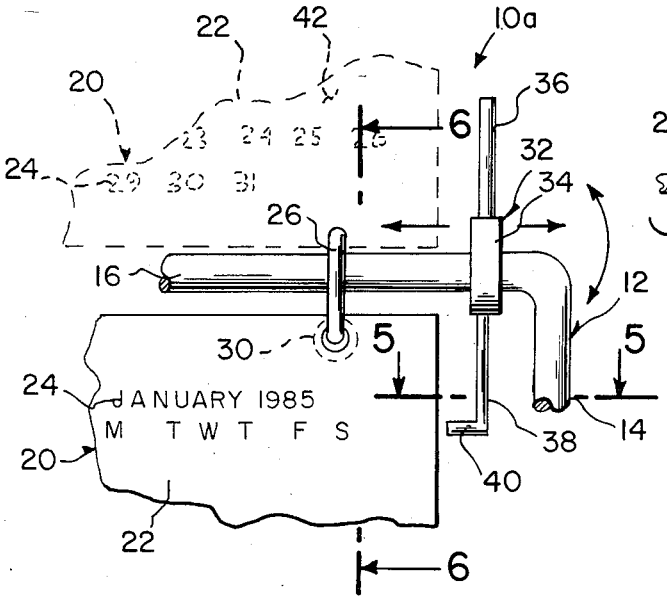
FIG. 4 is a front view with parts broken away of another modification having a page turner and each calendar page having same month printed on back upside down so that when page is flipped up a person can view current month and last month at the same time.
Figure 5:
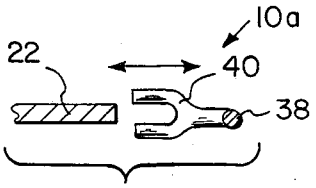
FIG. 5 is a cross sectional view taken along line 5—5 in FIG. 4 showing the fork of the page turner in greater detail.
Figure 6:
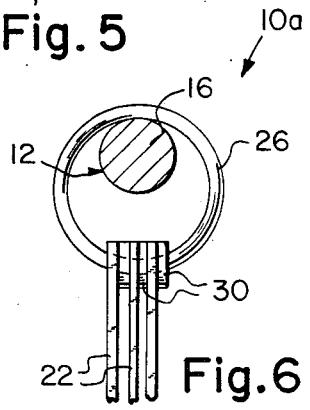
FIG. 6 is a cross sectional view taken along line 6—6 in FIG. 4 showing the reinforcers and spacers between the calendar pages in greater detail.

FIGS. 4, 5 and 6 show a modified desk top swing calendar 10*a* further containing a plurality of spacer reinforcers 30, each of which is placed between each of the calendar pages 22 on each of the rings 26 so as to allow the calendar pages 22 to hang thereabout. A page turner 32 is provided which includes a manually rotatable collar 34 slideably mounted on the cross beam member 16 of the support frame 12. The collar 34 has a handle 36 extending outwardly therefrom and an arm 38 extending outwardly and opposite from the handle 36. The arm 38 has a right angle forked end 40 so as to engage with side of each one of the calendar pages 22 to turn the calendar pages one at a time when needed. Each of the pages 22 of the calendar tablet 20 has same month, year and date, indicia 24 upside down on rear surface 42 thereon so that when one of the calendar pages 22 is turned both present month and following month can be viewed simultaneously.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A desk top swing calendar which comprises:

(a) a support frame having a pair of side legs and a cross beam member;

(b) a clock mounted within said cross beam member of said support frame to indicate time of day;

(c) a calendar tablet having a plurality of pages with month, year and date indicia thereon; and (d) means for suspending said calendar tablet on said cross beam member of said support frame so that said pages can be manually flipped over to expose each month of the year.

2. A desk top swing calendar as recited in claim 1, wherein said side legs and said cross beam member of said support frame are detachable from each other so as to allow replacement of said calendar tablet when needed.

3. A desk top swing calendar as recited in claim 2, wherein said suspension means includes a plurality of rings extending through top of said calendar tablet and around said cross beam member of said support frame.

4. A desk top swing calendar as recited in claim 3, wherein said clock is of a liquid crystal display type.

5. A desk top swing calendar as recited in claim 4, wherein each of said pages of said calendar tablet further includes therein a small calendar being of the same month and cut out on both sides and bottom which can be manually flipped up to expose following month underneath said page.

6. A desk top swing calendar as recited in claim 4, further comprising:

(a) a plurality of spacer reinforcers, each of which is placed between each of said calendar pages on each of said rings so as to allow said calendar pages to hang thereapart;

(b) a page turner which includes a manually rotatable collar slideably mounted on said cross beam member of said support frame, said collar having a handle extending outwardly therefrom and an arm extending outwardly and opposite from said handle, said arm having a right angled forked end so as to engage with side of each one of said calendar pages to turn said calendar pages one at a time when needed; and (c) each of said pages of said calendar tablet having same month, year and date indicia upside down on rear surface thereon so that when one of said calendar pages is turned both present month and following month can be viewed simultaneously.

* * * * *